US009810024B2

(12) United States Patent
Koka

(10) Patent No.: US 9,810,024 B2
(45) Date of Patent: Nov. 7, 2017

(54) DRILL SYSTEM

(71) Applicant: Caterpillar Global Mining America LLC, Houston, PA (US)

(72) Inventor: Naveen Koka, Oakdale, PA (US)

(73) Assignee: Caterpillar Global Mining America LLC, Houston, PA (US)

( * ) Notice: Subject to any disclaimer, the term of this patent is extended or adjusted under 35 U.S.C. 154(b) by 268 days.

(21) Appl. No.: 14/674,660

(22) Filed: Mar. 31, 2015

(65) Prior Publication Data

US 2016/0290048 A1 Oct. 6, 2016

(51) Int. Cl.
*E21B 7/02* (2006.01)

(52) U.S. Cl.
CPC ..... *E21B 7/025* (2013.01); *E21B 7/028* (2013.01)

(58) Field of Classification Search
CPC ..... E21B 7/025; E21B 7/028
USPC ..... 175/57
See application file for complete search history.

(56) References Cited

U.S. PATENT DOCUMENTS

| | | | | |
|---|---|---|---|---|
| 2,627,985 | A * | 2/1953 | Sathre | B66C 23/92 188/317 |
| 2,646,968 | A | 7/1953 | Curtis | |
| 3,020,012 | A | 2/1962 | Moracco et al. | |
| 3,028,922 | A | 4/1962 | Hudnall, Jr. | |
| 3,917,310 | A | 11/1975 | Mitsuishi | |
| 4,039,032 | A | 8/1977 | Morrison | |
| 4,190,385 | A * | 2/1980 | Childress | E21D 20/003 175/219 |
| 4,229,124 | A * | 10/1980 | Frey | E21D 20/028 173/184 |
| 4,398,850 | A * | 8/1983 | Talvensaari | E21D 20/006 173/193 |
| 4,436,455 | A | 3/1984 | Vance | |
| 6,698,978 | B2 | 3/2004 | Albertson et al. | |
| 2014/0084628 | A1* | 3/2014 | Sutar | B21D 9/00 296/190.03 |
| 2014/0112724 | A1* | 4/2014 | Nelson | E21D 20/00 405/259.1 |

* cited by examiner

*Primary Examiner* — Taras P Bemko

(57) ABSTRACT

A drill system, a machine, and a method of operating the same, are disclosed. In one aspect, a machine includes a machine frame coupled to at least one ground engaging element, a power source configured to generate a power output for driving the at least one ground engaging element, and a cabin structure coupled to the machine frame and having an overhead portion configured to provide overhead protection to an operator. The machine further including a boom coupled to the overhead portion of the cabin structure and a drill assembly moveably coupled to the boom.

14 Claims, 6 Drawing Sheets

DRILL SYSTEM

TECHNICAL FIELD

This disclosure relates generally to a drill system and, more particularly, to a mobile drill system for a mining machine.

BACKGROUND

Various drill systems such as the so-called jumbo drills are typically used in underground mining and tunneling environments. Conventional jumbo drills may have issues with visibility and may include complex and congested hoses and cables that extend through one or more articulation joints of a boom. The front weight of jumbo drills is greater compared to a rear weight because of the implements (e.g., boom, drill, feeder, hoses, hardware components and the like) mounted to the front of the jumbo drill carrier. Such implement placement occupies forward space and may negatively affect tramming and turns of the jumbo drill during operation, such as within a mine tunnel.

As an example, U.S. Pat. No. 4,436,455 describes a low profile mine drilling machine including a low profile traction carriage limited in height by the rubber tire diameter. The carriage thus can enter a low ceiling mine shaft of less than thirty inches (0.76 cm) and manipulate therein into any desired position a drilling auger positioned underneath and parallel with boom. As a further example, U.S. Pat. No. 3,028,922 describes a drilling machine including a drill slideably mounted on a mobile carrier. However, such drill machines may not provide sufficient protection for a human operator.

Accordingly, improvements in drill system configuration are needed, while maintaining operator safety and visibility. These and other shortcomings of the prior art are addressed by the disclosure.

SUMMARY

In one aspect, the disclosure describes a machine including a machine frame coupled to at least one ground engaging element, a power source configured to generate a power output for driving the at least one ground engaging element, a cabin structure coupled to the machine frame and having an overhead portion configured to provide overhead protection to an operator, a boom coupled to the overhead portion of the cabin structure, and a drill assembly moveably coupled to the boom.

In another aspect, the disclosure describes a method including causing a boom to move into an extended position relative to a cabin structure of a machine, wherein the boom is coupled to an overhead portion of the cabin structure of the machine, perform a drilling operation using a drill assembly coupled to the boom, causing the boom to move into a retracted position, and causing the machine to move, while the boom is in the retracted position.

In yet another aspect, the disclosure describes a drilling system including a boom configured to be moveably coupled to the overhead portion of the cabin structure of a machine, a drill feed coupled to the boom, and a drill assembly moveably coupled to the drill feed and configured to translate along an axis of the drill feed.

DETAILED DESCRIPTION

The disclosure relates, in an aspect, to a drill system including one or more booms coupled to a portion of an operator cabin of a machine frame (e.g., carrier). As an example, the one or more booms may be coupled to a top portion of the roll over protection structure (ROPS) or falling objects protection structure (FOPS). As another example, the one or more booms mount to and may be slideably coupled to the operator cabin to allow the booms to articulate between a first position (e.g., retracted position) and a second position (e.g., extended position). In this way, the one or more booms (and implements coupled thereto) may be retracted for machine movement such as tramming. During operation, the one or more booms may be extended and locked in position. By placing the one or more booms on the cabin (e.g., ROPS/FOPS structure), hose, cables, and harness lengths may be shortened and may be routed so as not to hang down and obstruct visibility. Furthermore, the overhead location of the one or more booms facilitates the loading of bolts or rods by the operator without having to exit the cabin. Moreover, the cabin height may be adjusted such that the total height of the machine with the overhead booms is within regulatory height and/or required height for a particular environment.

Figure 1:
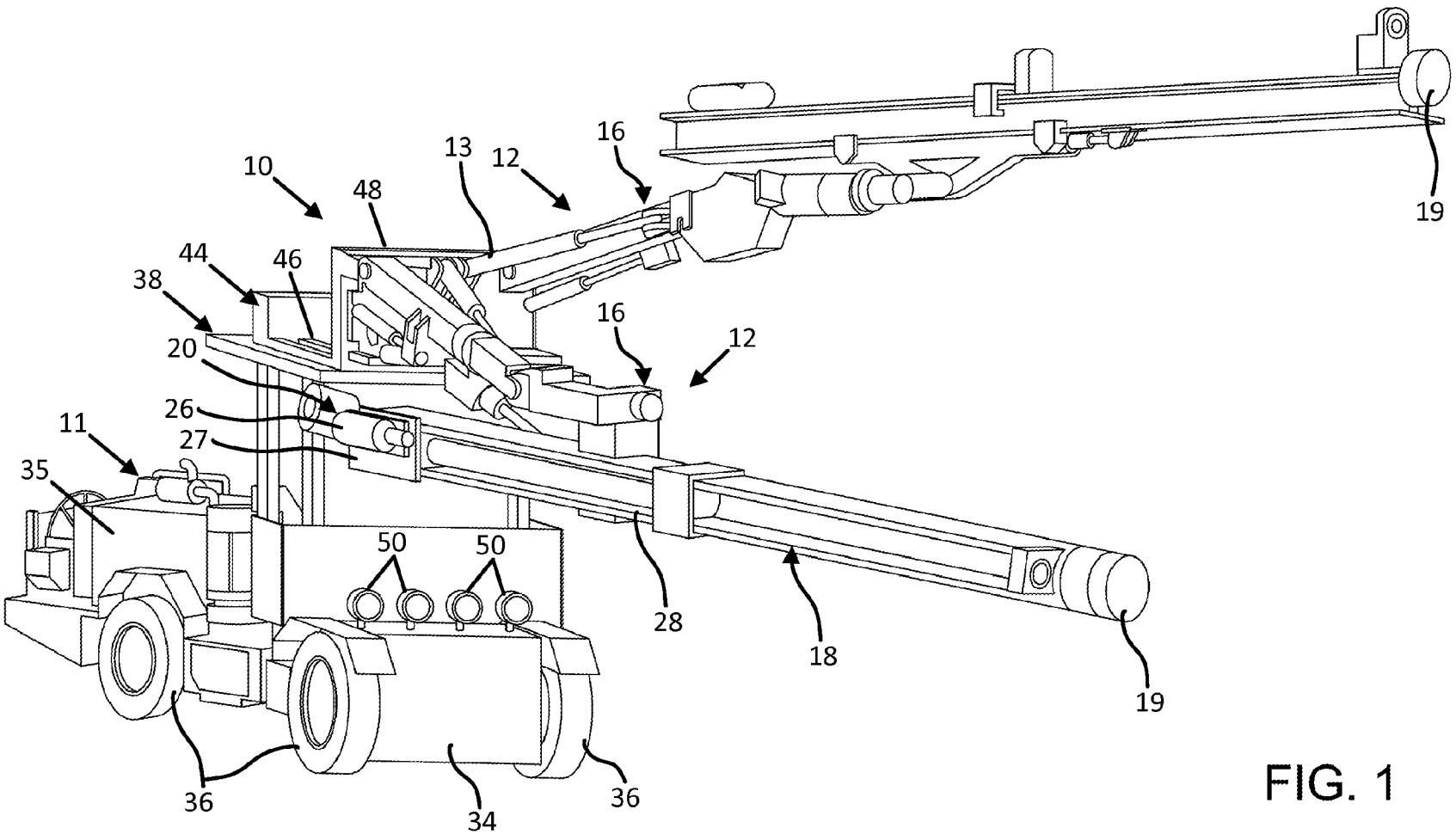
FIG. 1 is a perspective view of a drill system in accordance with aspects of the disclosure.
Figure 2:
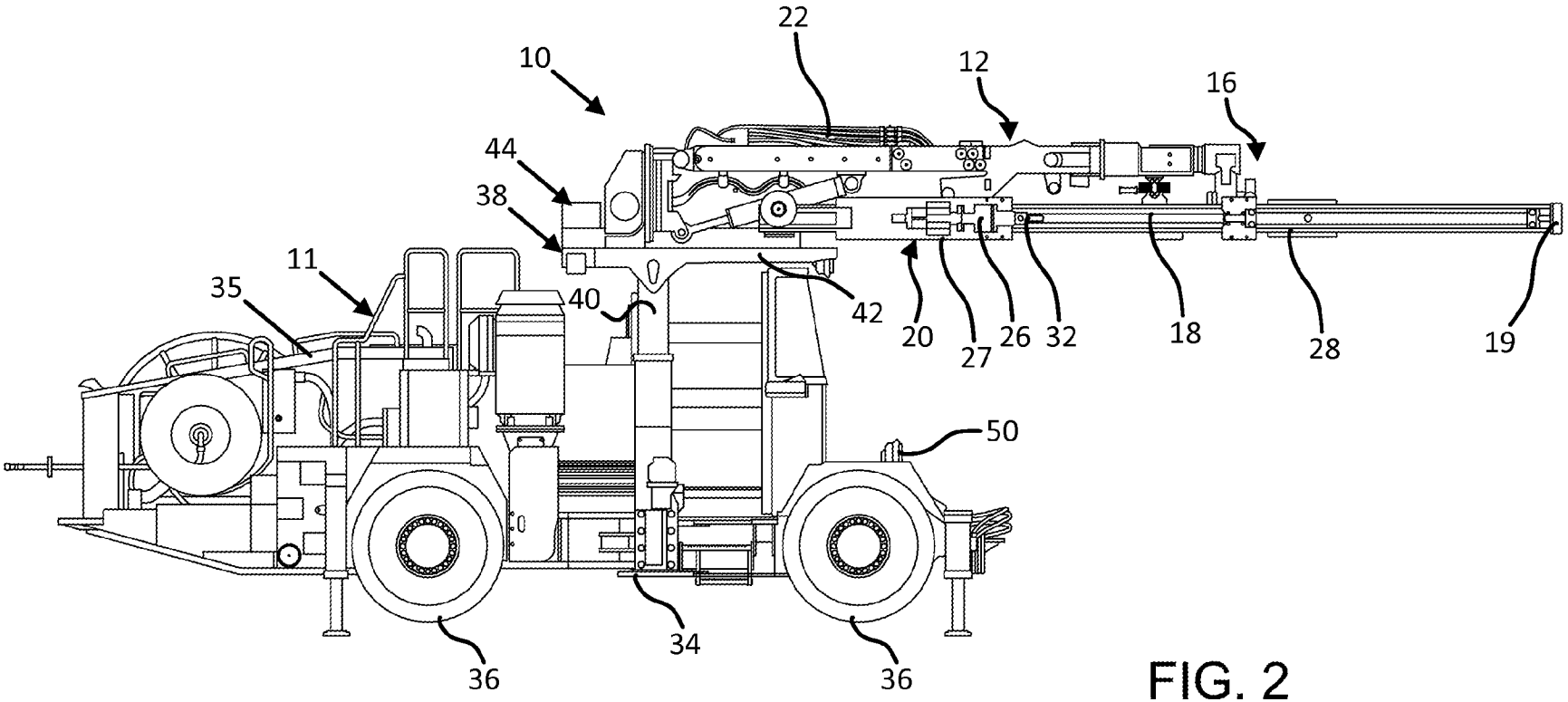
FIG. 2 is a side elevation view of the drill system of FIG. 1, showing a pair of booms in a retracted position.
Figure 3:
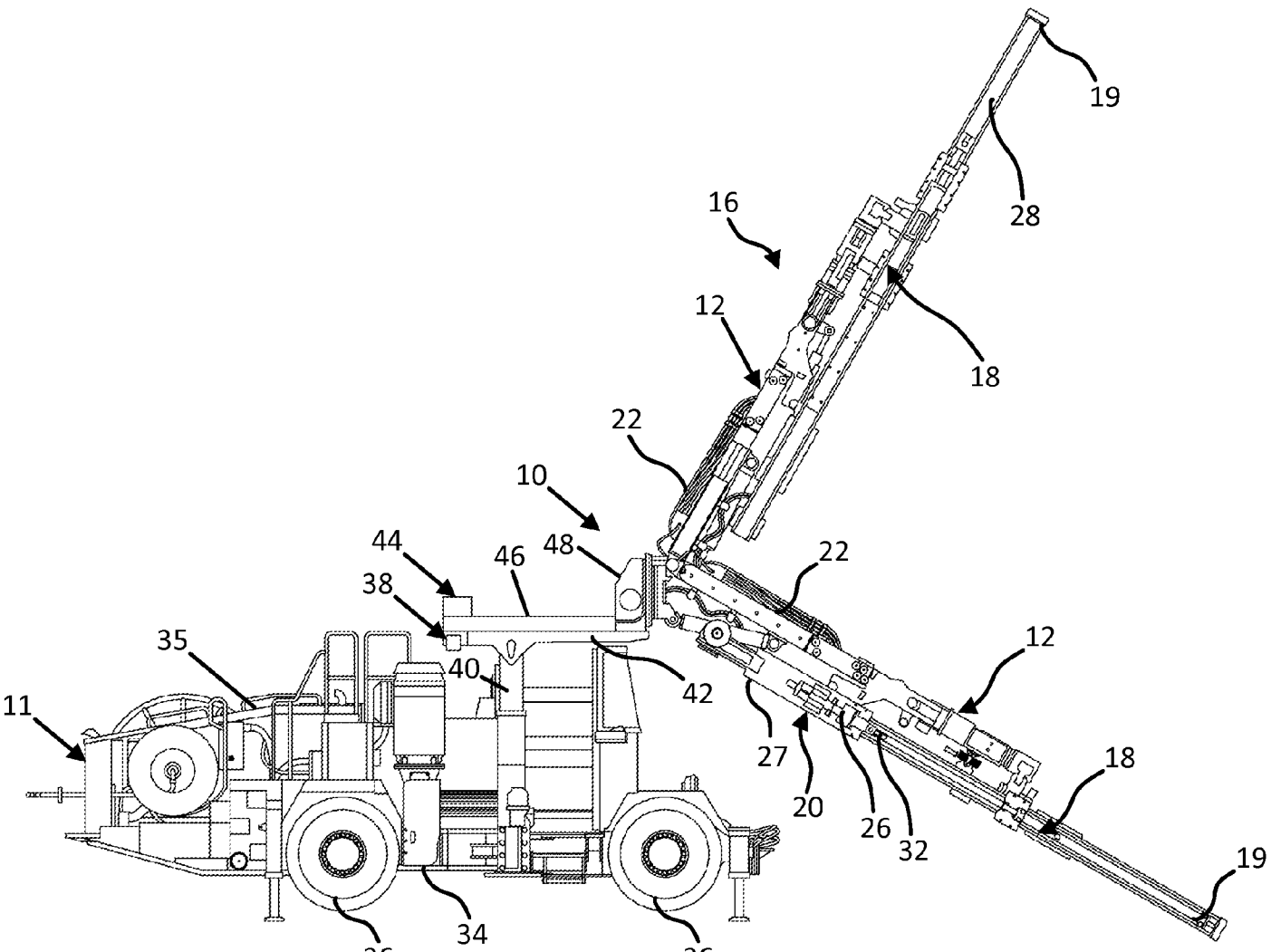
FIG. 3 is a side elevation view of the drill system of FIG. 2, showing the pair of booms in an extended position.

Referring to the figures, FIGS. 1, 2, and 3 illustrate an aspect of a drill system 10 (e.g., rock drill system) in accordance with the disclosure. The drill system 10 may be used, for example, to drill holes into rock formations or any other material. Furthermore, the drill system 10 may be configured such that holes may be drilled vertically, horizontally, or at any suitable angle. The drill system 10 shown in FIG. 1 is a portable system mounted on a machine 11, such as tracked utility machine, wheeled machine, or any other suitable machine, via a pivotable or otherwise movable boom or booms 12. The machine 11 may include one or multiple booms 12. The drill system 10 may also be pivotally or otherwise movably mounted to the boom 12 so that the drill system 10 may positioned at any suitable angle with respect to the boom 12. As another example, the drill system 10 may be mounted on a fixed structure, such as a stationary frame, via a movable boom. In an aspect, the booms 12 may include one or more hydraulic cylinders 13 to control the articulation of the booms 12. Such hydraulic cylinders 13 may be configured with double-activating lock checks, as would be appreciated by one of skill in the art.

In an aspect, the drill system 10 may include a support arrangement 16 having a drill feed 18, a rock drill assembly 20 movably associated with the drill feed 18. The drill feed 18 may have static length or may be telescopic. The drill feed 18 may include a stinger 19 (e.g., built-in stinger, oversized stinger pad) and/or centralizer bushings with external wear indicators. As such, the stinger 19 allows the operator to provide constant pressure on a drill surface to minimize jammed and/or broken drill parts.

In an aspect, the drill system 10 may include one or more fluid conductors 22, such as hoses, associated with the rock drill assembly 20 for conveying media toward and/or away from the rock drill assembly 20. The rock drill assembly 20 may include a rock drill 26 mounted on a drill slide bracket 27, which may be slidably mounted on one or more guide rails 28 of the drill feed 18. In an aspect, one or more drill rods (e.g., drill rods 130 (FIG. 5) may be removably coupled to the rock drill 26, along with an associated drill bit 32 coupled to an end of one of the drill rods 130, as is described in further detail herein.

In an aspect, the machine 11 may include a machine frame 34 coupled to one or more ground engaging elements 36. As an example, the ground engaging elements 36 may include a wheel or a track. A power source 35, such as an internal combustion engine, may be coupled to the machine frame 34 and may be configured to generate a power output for driving at least one of the ground engaging elements 36. A cabin structure 38 may be coupled to the machine frame 34 and may be configured to provide protection to an operator of the machine 11. As an example, the machine 11 and/or the cabin structure 38 may be or include a ROPS and/or FOPS. The ROPS and/or the FOPS may be integrated with, or form portions or the entirety of, the cabin structure 38. The cabin structure 38 may serve as a protective framework for the operator in an unlikely event of machine roll-over. The cabin structure 38 may be fabricated in such a fashion that it may withstand weight of the machine 11 in the event of the roll-over of the machine 11. The cabin structure 38 may include one or more vertical supports 40 and an overhead portion 42 configured to provide overhead and/or rollover protection for an operator. In the case of a rollover, the cabin structure 38 may absorb energy and prevent the cabin structure 38 from being crushed due to the forces acting upon it. The overhead portion 42 may include a crossbeam, a planar roof, or other configuration. The overhead portion 42 may be configured as a canopy assembly to be disposed over an operator and extending over at least a portion of the machine frame 34 to protect the machine 11 and the machine operator from falling objects such as rocks and boulders dislodged during excavation operations.

In an aspect, the drill system 10 may be coupled to a portion of the cabin structure 38. As an example, the booms 12 may be coupled to the overhead portion 42 of the cabin structure 38. As another example, the booms 12 may be slideably coupled to the overhead portion 42 of the cabin structure 38. A mount 44 may be coupled to or integrated with the cabin structure 38 and may include one or more guide rails 46 configured to slideably guide a wall 48 of the mount 44 in translation. One or more of the booms 12 may be pivotably coupled to the wall 48 of the mount 44 such that the booms 12 can pivot and move relative to the mount 44. Further, the wall 48 may be caused to translate along an axis to shift the booms 12 (and components coupled to the booms 12) between a first position (shown in FIG. 2) and a second position (shown in FIG. 3). In this way, the wall 48 may be retracted into a first position for easier navigation of the machine 11, such as during tramming.

During a drill operation, the wall 48 may be moved into the second position and locked in position. The wall 48 may be configured to translate along guide rails 46 and may be configured to articulate in other dimensions, such as via articulating joints configured in the wall 48 and/or coupling the wall 48 to the mount 44. As would be understood, a chain drive or cylinder drive system may be configured to cause motion of the mount 44 along the guide rails 46. By coupling the booms 12 to the cabin structure 38 (e.g., ROPS/FOPS structure), hose, cable, and harness lengths may be shortened and may be routed so as not to hang down and obstruct visibility of the operator in the cabin structure 38 (or hang down and obstruct visibility of the operator in the cabin structure 38 in a much more limited manner). Furthermore, the overhead location of the booms 12 facilitates the loading of bolts by the operator without having to exit the protections afforded by the cabin structure 38. Moreover, a height of the cabin structure 38 may be adjusted such that the total height of the machine 11 with the cabin structure 38, mount 44 and booms 12 is within regulatory height and/or required height for a particular environment. In certain aspects, light emitting devices 50 may be disposed on a portion of the machine 11, such as a front portion below the booms 12.

Figure 4:
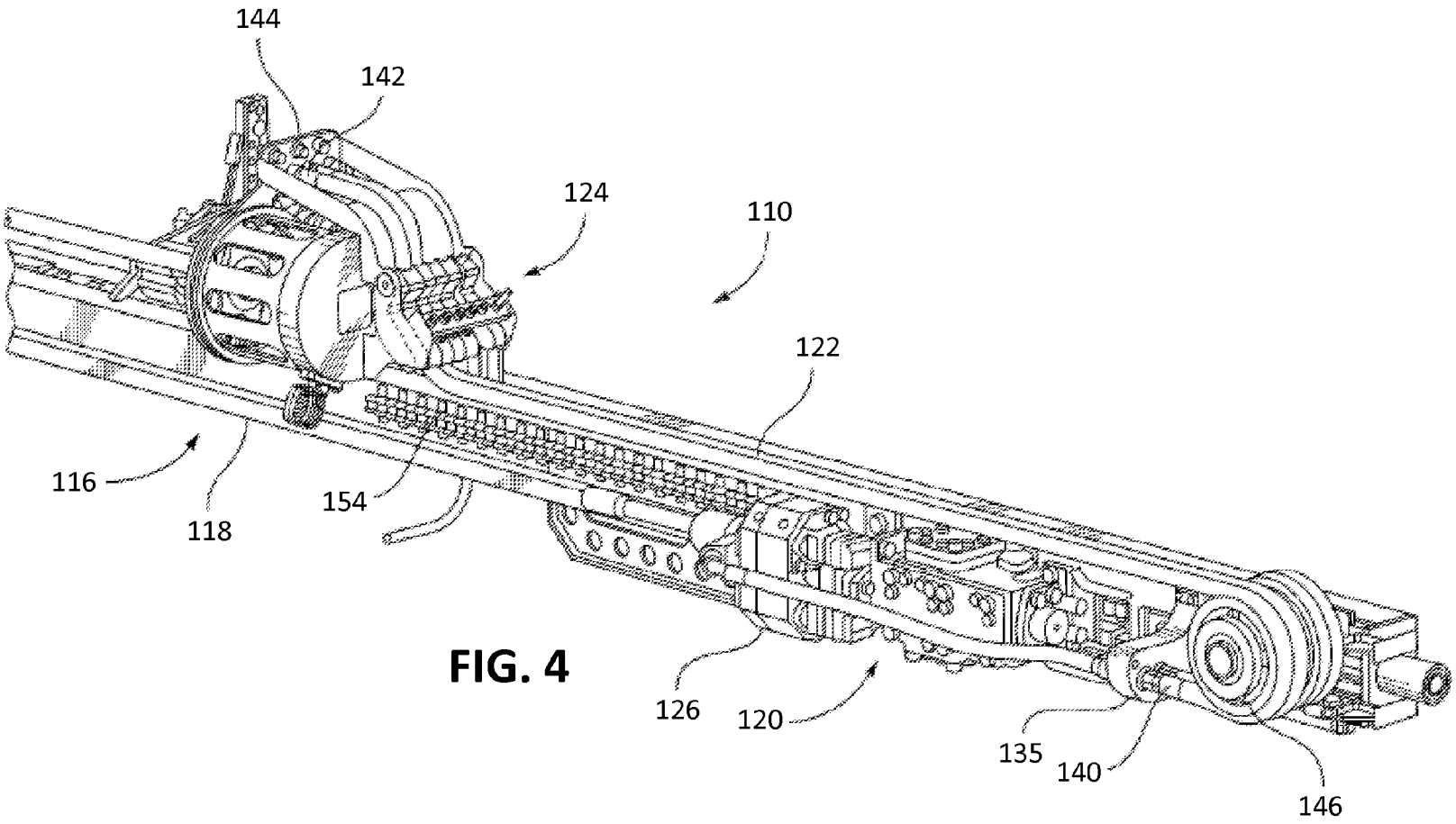
FIG. 4 is a perspective view of a drill system in accordance with aspects of the disclosure.
Figure 5:
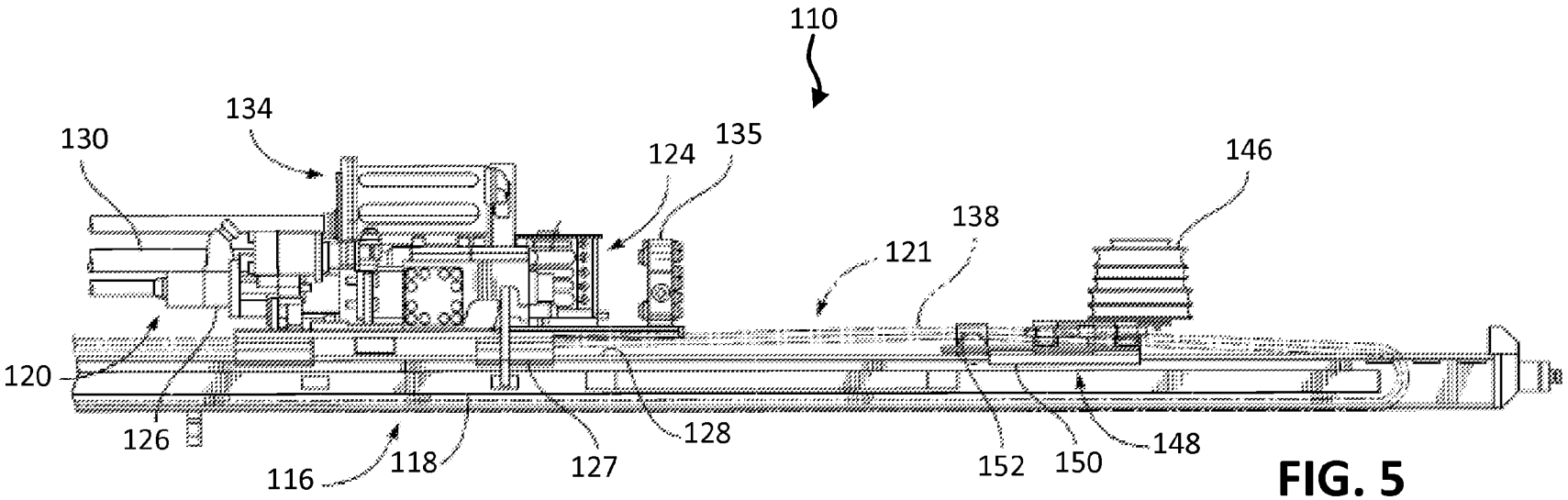
FIG. 5 is a side elevation view of the drill system of FIG. 4.

Referring to FIGS. 4 and 5, a drill system 110 according to aspects of the disclosure may include a support arrangement 116 having a drill feed 118, a rock drill assembly 120 movably associated with the drill feed 118, and a drive system 121 for moving the rock drill assembly 120 along the drill feed 118. The drill system 110 further includes one or more fluid conductors 122, such as hoses, associated with the rock drill assembly 120 for conveying media toward and/or away from the rock drill assembly 120, and a tensioning arrangement 124 for tensioning the fluid conductors 122.

The rock drill assembly 120 includes a rock drill 126 mounted on a drill slide bracket 127, which may be slidably mounted on one or more guide rails 128 of the drill feed 118. One or more drill rods 130 may be removably coupled to the rock drill 126, along with an associated drill bit (not shown) coupled to an end of one of the drill rods 130. The rock drill 126 is configured to sufficiently move the drill rods 130 and drill bit so that the drill bit can fracture or otherwise break up rock or other material to form a hole. The rock drill 200 may also slide along the drill feed 118 to move the drill bit downward, for example, so that the drill bit can make the hole deeper. When the rock drill 126 reaches an end, such as a lower end, of the drill feed 118, the rock drill 126 may be disconnected from the one or more drill rods 130 and moved to an opposite end of the drill feed 118. Another drill rod 130 may then be connected between the rock drill 126 and the existing drill rods 130, and drilling may resume. In that regard, the drill system 110 may include a rotatable rod carousel arrangement 134 that holds one or more drill rods 130 and that may be rotated to position an additional rod 130 between the rock drill 126 and the existing drill rods 130.

The rock drill assembly 120 further includes a connection section 135, such as a manifold or bulkhead, connected to the rock drill 126 for receiving the fluid conductors 122 (only two fluid conductors 122 are shown in FIG. 2 for clarity purposes, but the illustrated aspect can accommodate up to six fluid conductors 122). The fluid conductors 122 may supply media to or remove media from the rock drill 126. For example, the drill system 110 may include one or more flushing fluid conductors 122 that supply pressurized air or water to the rock drill 126, one or more supply fluid conductors 122 that supply pressurized hydraulic oil to the rock drill 126, one or more return fluid conductors 122 that remove hydraulic oil from the rock drill 126, and one or more lubrication fluid conductors 122 that supply lubricating fluid to the rock drill 126 or other components. Such media may be conveyed to or from the fluid conductors 122 via other fluid conductors that extend to other components of the drill system 110, such as pumps, reservoirs, etc.

Referring to FIG. 5, the drive system 121 may be any suitable system for moving the rock drill assembly 120 along the drill feed 118. For example, the drive system 121 may be a chain drive system including a chain 138 having first and second ends connected to opposite ends of the rock drill assembly 120. The chain 138 and rock drill assembly 120 may form a loop with the chain 138 wrapping around a drive sprocket and one or more additional sprockets, such as an idler sprocket and a drive idler sprocket. The drive sprocket may be driven by a motor, such as an electric motor or hydraulic motor, causing the chain 138 and rock drill assembly 120 to move.

As the rock drill assembly 120 moves, the fluid conductors 122 connected to the connection section 135 of the rock drill assembly 120 also move. In that regard, referring to FIG. 4, each fluid conductor 122 has a first end 140 fixedly connected to the connection section 135 and an opposite second end 142 fixedly connected to or otherwise associated with the support arrangement 116. For example, each first end 140 may include a threaded fitting that is connected to a threaded fitting on the connection section 135 of the rock drill assembly 120, and each second end 142 may include a threaded fitting that is connected to a threaded fitting on a bulkhead 144 of the support arrangement 116. Furthermore, the fluid conductors 122 extend around a guide arrangement, such as one or more drums, sheaves or rollers, movable mounted on the drill feed 118. In the aspects shown in FIGS. 4 and 5, the guide arrangement includes a drum 146 that is rotatable and translatable with respect to the drill feed 118, and that includes multiple grooves for receiving the fluid conductors 122.

As the rock drill assembly 120 translates a particular distance with respect to the drill feed 118, the drum 146 may be configured to translate a portion of that distance so that the length of the fluid conductors 122 may remain constant. For example, the drill system 110 may include a reduction mechanism, such as a sprocket-chain reduction mechanism, that enables the movement of a portion, such as half, of the distance that the rock drill assembly 120 moves. As a more detailed example, referring FIG. 5, the drum 146 may be mounted on a drum slide assembly 148 including a drum slide 150 and a reduction sprocket 152 that is rotatably mounted on the drum slide 150 and that extends between the drive system chain 138 and a fixed section of chain 154 (shown in FIG. 4) mounted on the drill feed 118. When the chain 138 is moved in order to move the rock drill assembly 120, the reduction sprocket 152 moves along the fixed chain section 154 and slides the drum slide 150 and drum 146 along the drill feed 118.

Figure 6:
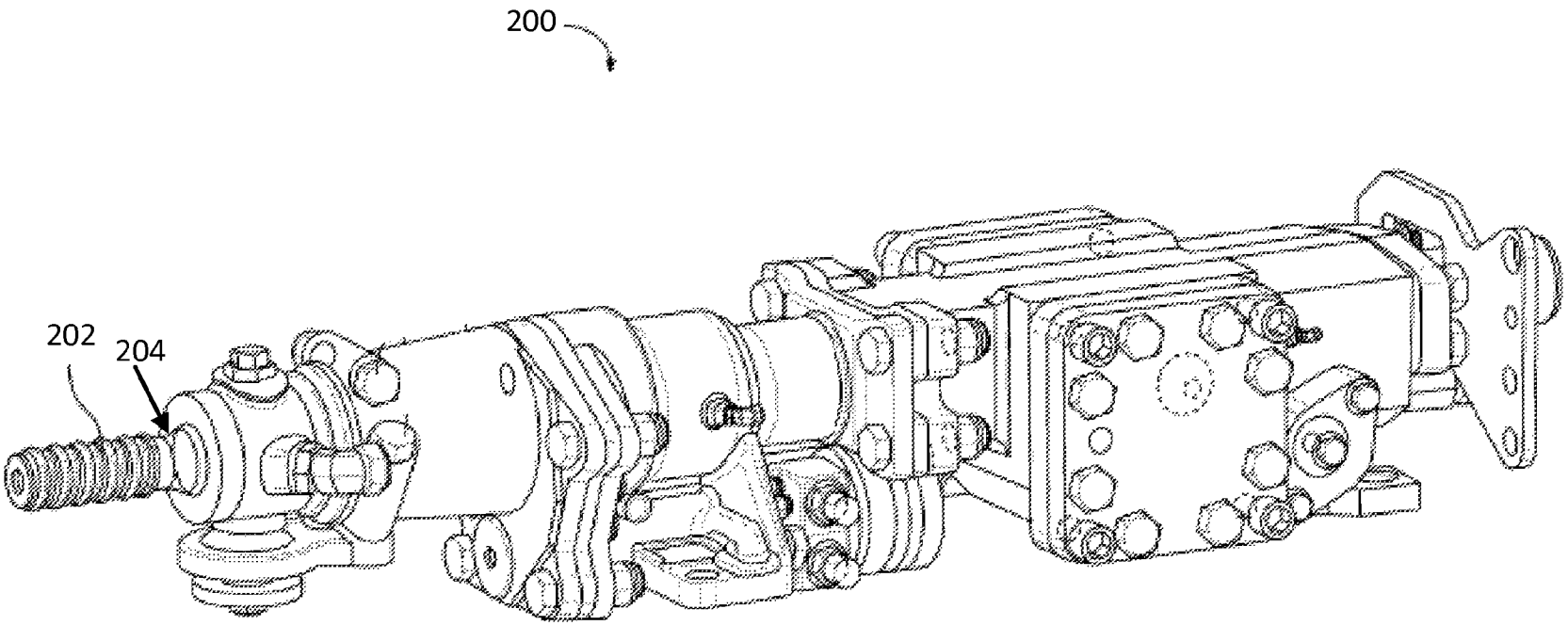
FIG. 6 is a perspective view of a drill assembly in accordance with aspects of the disclosure.

Referring to FIG. 6, a rock drill 200 (i.e., device) is shown according to aspects of the disclosure. As an example, the rock drill 200 can be used with the rock drill assembly 20 of FIG. 1. The rock drill 200 includes a drill tool 202 (i.e., hammer, chisel, cutting surface, bit, etc.) positioned at the end of a drill shank 204 (i.e., rotatable drill shank) and configured to strike rock or another surface (i.e., the drilling surface) in order to drill a hole into the drilling surface. In an exemplary aspect, the rock drill 200 includes a percussive system configured to oscillate or otherwise drive the drill shank 204 and the drill tool 202 in an axial motion (i.e., a longitudinal motion between two points along the axis of the drill shank 204, to the left and to the right according to FIG. 6), causing the drill tool 202 to strike the drilling surface. The rock drill 200 also includes a rotative system configured to axially rotate the drill shank 204 (and thus the drill tool 202) and/or a drill string (not shown) surrounding the drill shank 204, such as to send flushing media to the drill tool 202, flushing rock, mud or other debris out of the annulus of the drilled hole. The rock drill 200 may also include one or more components configured to enable the axial rotation of the drill shank 204 and/or to inhibit or limit the axial motion of the drill shank 204 (i.e., the longitudinal motion along the axis of the drill shank 204) as the rock drill 200 performs a drilling operation.

INDUSTRIAL APPLICABILITY

The present disclosure is applicable to various drilling systems. As an example, the drilling systems and related machines may be used in underground mining and tunneling. The drilling systems may be used for hard- and soft-rock mining under harsh underground conditions, for example, for blast holes, cross cut drilling, bolting and grouting, for example. Certain applications include mining of nickel, copper, gold, zinc, diamonds, salt, limestone, iron ore, platinum and granite. The drilling machines may be used for horizontal drilling (e.g., drifting, ramping and tunneling), and may have one or two booms, each with independent control systems to allow simultaneous drilling. Control of the booms may be either manual/hydraulic or electric/hydraulic. The drilling systems of the disclosure may be mounted on a carrier with a diesel engine for tramming and an electric power pack for drilling.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. A machine comprising:

a machine frame coupled to at least one ground engaging element;

a power source configured to generate a power output for driving the at least one ground engaging element;

a cabin structure coupled to the machine frame and having an overhead portion configured to provide overhead protection to an operator;

a boom coupled to the overhead portion of the cabin structure; and a drill assembly moveably coupled to the boom;

wherein the boom is slideably coupled to the overhead portion of the cabin structure via a mount, and wherein the mount comprises a wall and the boom is coupled to the wall.

2. The machine of claim 1, wherein the cabin structure comprises one or more of a rollover protection structure and a falling objects protective structure.

3. The machine of claim 1, wherein the cabin structure comprises a vertical support coupled to the overhead portion of the cabin structure and configured to support at least the weight of the machine frame.

4. The machine of claim 1, wherein the boom is configured to translate between a retracted position and an extended position relative to the cabin structure via a movement of the mount.

5. The machine of claim 1, wherein the boom is pivotably coupled to the wall.

6. A method comprising:

causing a boom to move into an extended position relative to a cabin structure of a machine, wherein the boom is coupled to an overhead portion of the cabin structure of the machine;

perform a drilling operation using a drill assembly coupled to the boom;

causing the boom to move into a retracted position; and causing the machine to move, while the boom is in the retracted position, wherein causing the boom to move into the extended position comprises causing a translation of a mount coupled to the boom and slideably coupled the cabin structure of the machine.

7. The method of claim 6, wherein causing the boom to move into the extended position further comprises causing a translation of the boom.

8. The method of claim 6, wherein the drilling operation comprises operating a rock drill of the drill assembly.

9. The method of claim 6, wherein causing the boom to move into the retracted position comprises causing a translation of the boom to minimize an overall height of the machine.

10. A drilling system comprising:

a boom configured to be moveably coupled to the overhead portion of the cabin structure of a machine;

a drill feed coupled to the boom; and a drill assembly moveably coupled to the drill feed and configured to translate along an axis of the drill feed, wherein the boom is pivotably coupled to a mount and the mount is configured to be moveably coupled to the overhead portion of the cabin structure of the machine, and wherein the boom is configured to translate between a retracted position and an extended position relative to the cabin structure via a movement of the mount.

11. The drilling system of claim 10, wherein the drill feed comprises at least one guide rail for controlling a movement of the drill assembly.

12. The drilling system of claim 11, wherein the drill assembly comprises a drill slide bracket configured to slideably engage the at least one guide rail to control the movement of the drill assembly.

13. The drilling system of claim 10, wherein the drill feed comprises a stinger.

14. The drilling system of claim 10, wherein the drill assembly comprises a rock drill.

* * * * *